US006637630B1

(12) United States Patent
Rivenburgh

(10) Patent No.: US 6,637,630 B1
(45) Date of Patent: Oct. 28, 2003

(54) ADJUSTABLE CLOTHING HANGER

(76) Inventor: Marie Rivenburgh, 5017 Cindy Way, Las Vegas, NV (US) 89146

( * ) Notice: Subject to any disclaimer, the term of this patent is extended or adjusted under 35 U.S.C. 154(b) by 0 days.

(21) Appl. No.: 10/098,704

(22) Filed: Mar. 14, 2002

Related U.S. Application Data

(60) Provisional application No. 60/328,690, filed on Oct. 10, 2001.

(51) Int. Cl.[7] ..... A41D 27/22

(52) U.S. Cl. ..... 223/85; 223/94

(58) Field of Search ..... 223/85, 89, 94; 24/578.1, 716; D6/315, 328, 324

(56) References Cited

U.S. PATENT DOCUMENTS 5,145,098 A * 9/1992 Tung ..... 223/94

6,062,445 A * 5/2000 Nakamoto ..... 223/94

* cited by examiner

*Primary Examiner*—John J. Calvert
*Assistant Examiner*—James Smith
(74) *Attorney, Agent, or Firm*—Anderson & Morishita; Robert Ryan Morishita

(57) ABSTRACT

An adjustable clothing hanger includes extension arms extending from the shoulders of a clothing hanger. The extension arms engage locks that secure the extension arms in a desired position. In one embodiment, the extension arms include receivers that mount to the ends of the shoulders. The extension arms are locked by an adjuster strip connected that engages the hook of the clothing hanger. In an alternate embodiment, the extension arms are supported and guided by a mount that is attached to the clothing hanger. An optional embodiment includes ridges engaging a detent to lock the extension arms in place.

4 Claims, 5 Drawing Sheets

ADJUSTABLE CLOTHING HANGER

RELATED APPLICATION DATA

The present application claims the priority of U.S. Provisional Application Ser. No. 60/328,690 entitled "Adjustable Clothing Hanger" filed by Applicant herein on Oct. 10, 2001.

FIELD OF THE INVENTION

The present invention relates to clothing hangers. Specifically, the present invention is a clothing hanger with adjustable length shoulders to accommodate clothing of varying width.

BACKGROUND OF THE INVENTION

Conventional clothing hangers known in the prior art include a hook positioned between two shoulders. Some clothing hangers further include a cross-piece connecting the shoulders to connect and brace the shoulders.

Many variations on the conventional clothing hanger have been developed. For example, it is known to include clips on the cross-piece from which a user may hang trousers. Similarly, it is known to mount clips or the like along the shoulders or across the cross-piece from which neckties may be hanged.

A particular problem with conventional clothing hangers is that the distance between the shoulders and the length of the shoulders are fixed. Thus, conventional clothing hangers must be formed in a variety of sizes to accommodate different size clothing. That is, the length of the shoulders varies to accommodate clothing of different width.

In response to this problem, a variety of adjustable hangers have been invented. For example, U.S. Pat. No. 4,391,395 shows a clothes hanger having extensions that telescope from hollow hanger arms. Similarly, U.S. Pat. No. 3,874,572 discloses a collapsible clothing hanger in which lower arm segments may be collapsed into hollow upper arm segments to allow the hanger to be folded into a compact shape. Likewise, U.S. Pat. No. 5,085,358, shows a clothes hanger having extensions that depend from the underside of the shoulders of a clothes hanger.

However, a number of problems are presented by these prior art designs. First, the use of hollow hanger arms to accommodate telescoping extensions can weaken the hanger and lead to bending or breakage under normal loads.

Second, these adjustable hangers cannot be retrofitted onto existing clothing hangers. Thus, totally new hangers must be manufactured and purchased by users to take advantage of the adjustable width. Consequently, these new hangers are often costly to make and use.

Therefore, it can be seen that there is a need in the art for a clothing hanger device that can be adjusted to fit a variety of sizes of clothing to obviate the need to have a variety of single-size hangers without substantially weakening the hanger while providing the flexibility to be retrofitted to existing clothing hangers.

SUMMARY OF THE INVENTION

The present invention is specifically adapted for a conventional clothing hanger having right and left shoulders with a hook centered therebetween. The present invention may be retrofitted onto an existing clothing hanger or, in an alternate optional embodiment, integrated into a clothing hanger.

Right and left extension arms are mounted to the hanger in alignment with the right and left shoulders, respectively. The right and left extension arms may be mounted to the surfaces of the right and left shoulders of the hanger, or, in an alternate embodiment, may be secured to a mount resting on the shoulders of the hanger. The extension arms are guided along the shoulders by the mount or by guides on the shoulders. The extension arms are secured in position by locks.

In an embodiment including a mount, the mount includes at least one panel substantially parallel to the plane formed by the hanger shoulders. The panel supports the right and left extension arms and locks to hold the extension arms at a desired position. In an optional embodiment, the mount additionally includes retainers such as holes or clips for clothing articles such as scarves, neckties, and the like.

The locks may take many forms. For example, the locks may include a series of notches along an adjuster strip that secure to the hook of the hanger. In another optional embodiment, the locks include a series of ridges mating with a detent. In any case, the locks serve to secure the right and left extension arms at a desired position with respect to the hanger as they are moved along the right and left shoulders.

It is an object of the invention to provide a clothing hanger device that can be adjusted to fit a variety of sizes of clothing without substantially weakening the hanger while providing the flexibility to be retrofitted to existing clothing hangers.

DESCRIPTION

Figure 1:
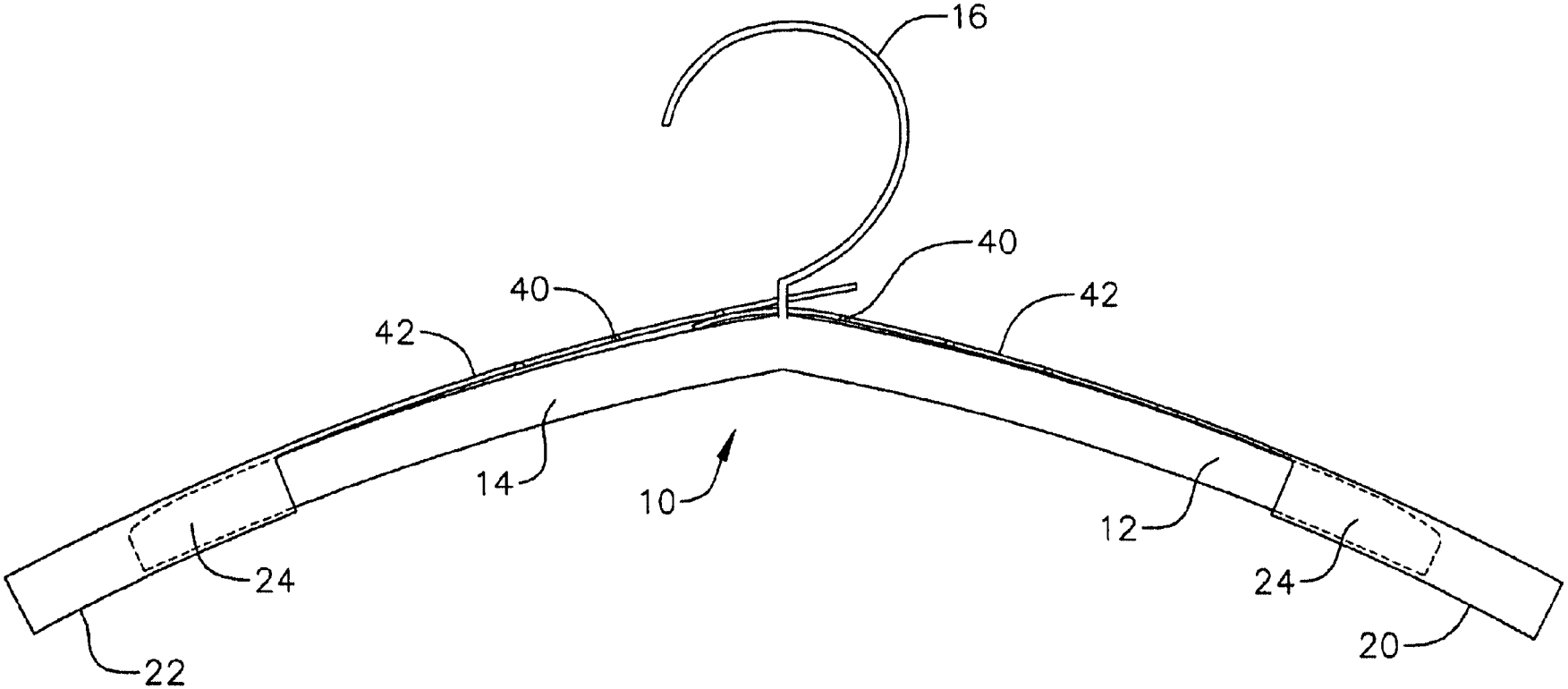
FIG. 1 is a front view of a clothing hanger according to an embodiment of the present invention.

Reference is now made to the figures wherein like parts are referred to by like numerals throughout. Referring first to FIG. 1, the present invention is particularly adapted for a clothing hanger 10 of conventional design. Such a clothing hanger 10 includes a right shoulder 12, a left shoulder 14, and a hook 16. In a further embodiment, the clothing hanger 10 may include a cross-piece 18 connecting the ends of the right shoulder 12 to the left shoulder 14. As may be appreciated, clothing hangers 10 are made of a variety of materials including wood, polymers, metal wire, and the like.

The present invention includes right and left extension arms 20, 22 that move relative to the clothing hanger 10 to allow the shoulders 12, 14 of the hanger 10 to be effectively increased or decreased in length. The right extension arm 20 and left extension arm 22 extend longitudinally from the right shoulder 12 and left shoulder 14, respectively. Optionally, the extension arms 20, 22 are dependent on, and in alignment with, the shoulders 12, 14.

Figure 2:
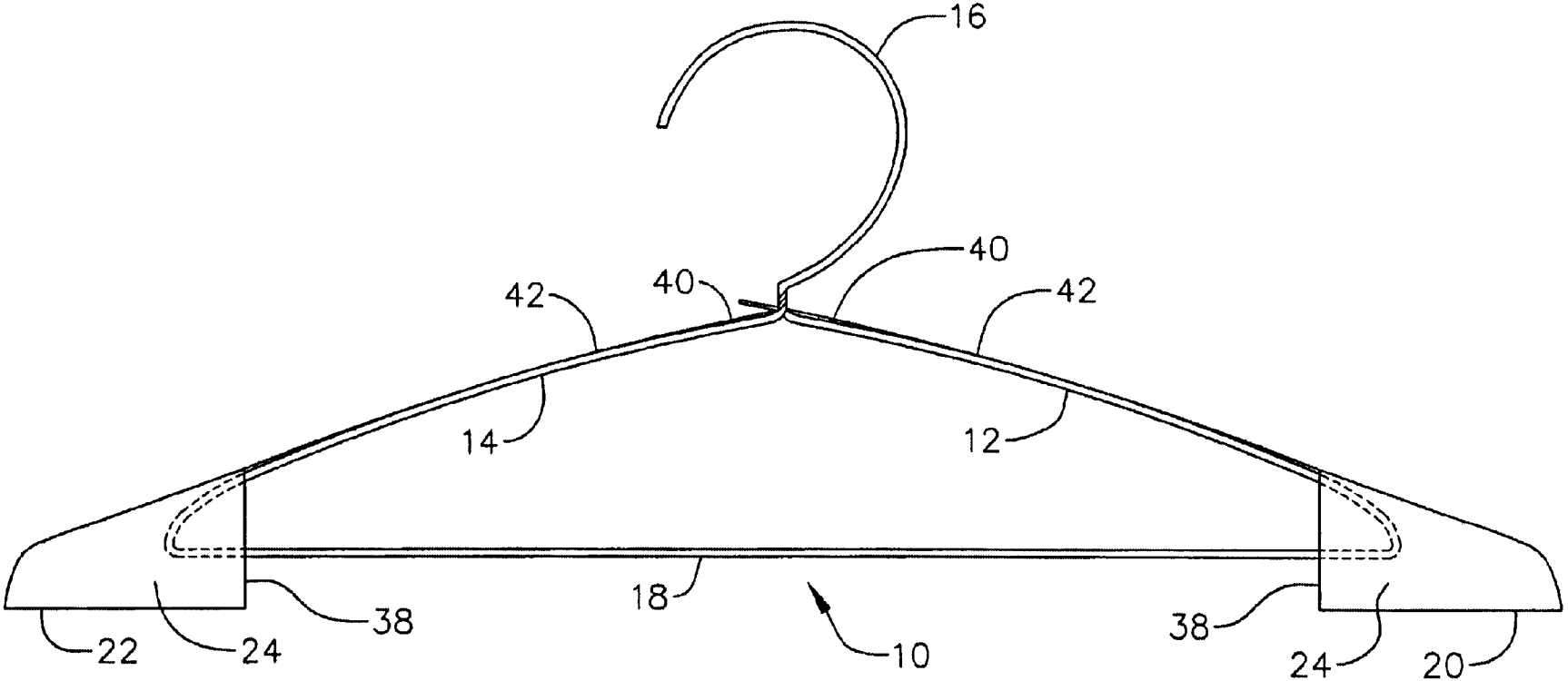
FIG. 2 is a front view of a clothing hanger according to an alternate embodiment of the present invention.

It is contemplated that the extension arms 20, 22 may be guided and supported by the hanger 10 in several different ways. In one optional embodiment, shown in FIGS. 1 and 2, each extension arm 20, 22 is guided by a receiver 24 that receives the end of the shoulder 12, 14. For example, an extension arm 20, 22 adapted for use with a hanger 10 with no cross-piece, as shown in FIG. 1 may include a tubular receiver 24 fitting over the end of the shoulder 12, 14. Similarly, an extension arm 20, 22 adapted for use with a hanger 10 including a cross-piece 18, as shown in FIG. 2, may include a triangular receiver 24 fitting over the end of the shoulder 12, 14 and cross-piece 18. Optionally, the embodiment of FIG. 2 may include a strut 38 to support the extension arm 20, 22 when extended. In the embodiments of FIGS. 1 and 2, the receiver 24 is of a length to permit the extension arms 20, 22 to be extended from the shoulders 12, 14 to a desired distance while still engaging the shoulders 12, 14 to provide guidance and support to the extension arms 20, 22.

Figure 3:
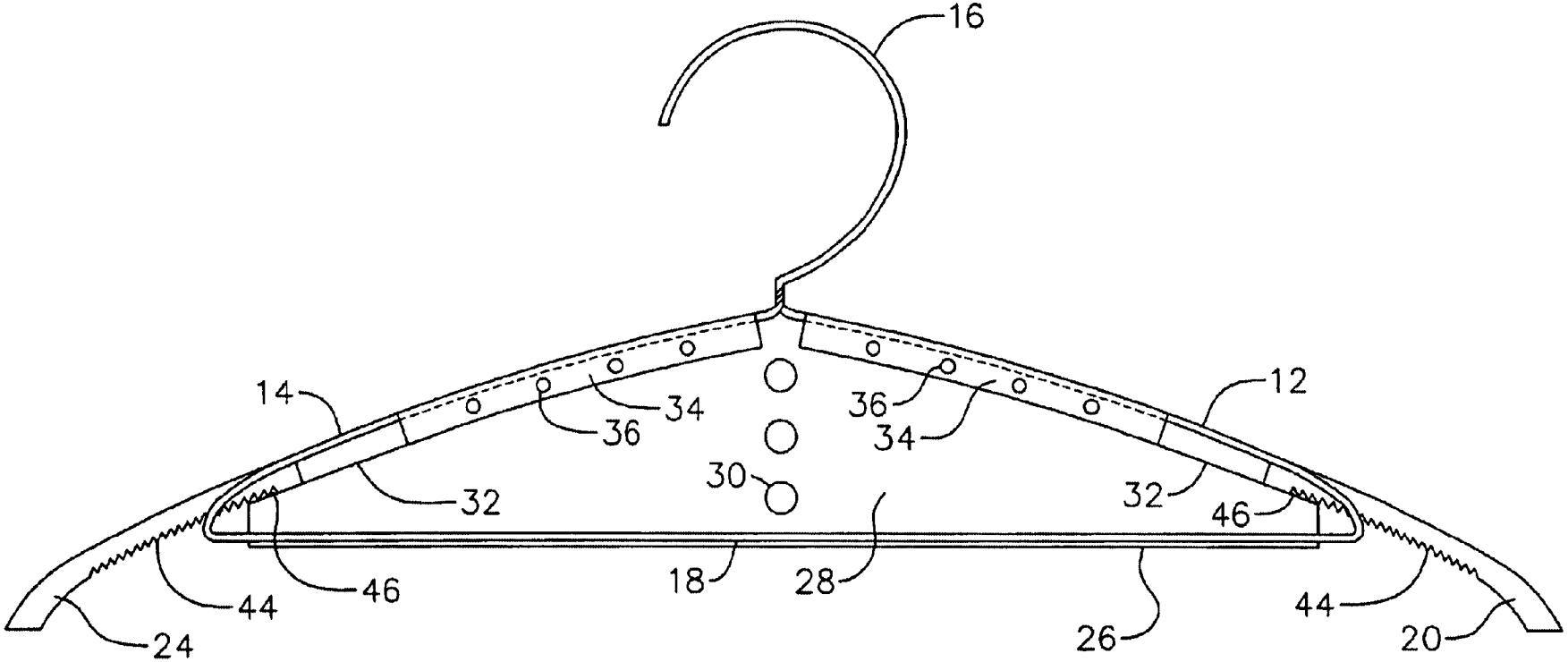
FIG. 3 is a front view of a clothing hanger according to an alternate embodiment of the present invention.
Figure 4:
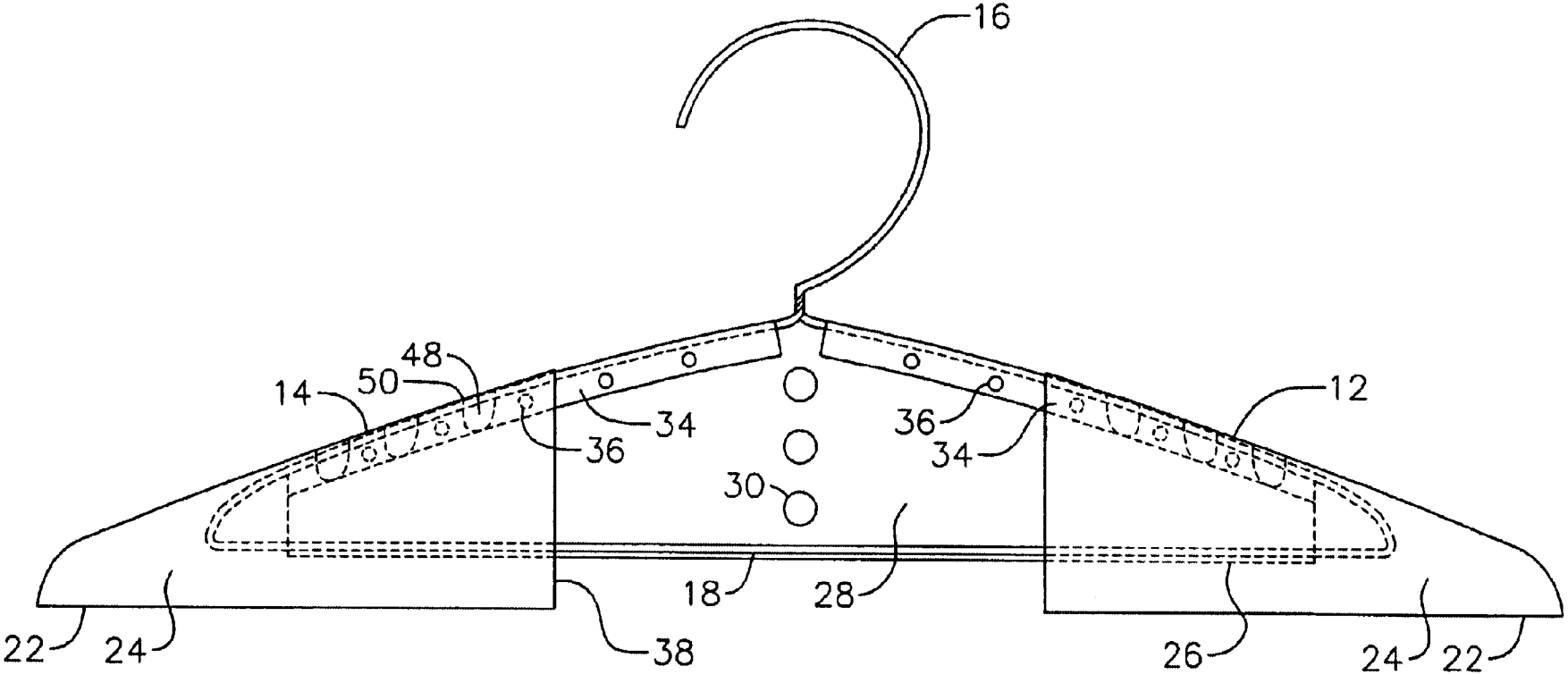
FIG. 4 is a front view of a clothing hanger according to an alternate embodiment of the present invention.

In an alternate optional embodiment, shown in FIGS. 3 and 4, a mount 26 may be provided that fits over the shoulders 12, 14 of a hanger 10, The mount 26 includes at least one panel 28 in a plane substantially parallel to the plane of the shoulders 12, 14. Optionally, the mount 26 could include another panel (not shown) to enclose the hanger 10 or, as shown in FIGS. 3 and 4, it may be open on one side. It is contemplated that the size and shape of the mount 10 could be altered to accommodate hangers 10 of different sizes and shapes. In an optional embodiment, the panel 28 of the mount 26 may include retainers such as clips or holes 30 to receive articles of clothing such as neckties, scarves, belts, or the like.

The mount 26 provides guidance and support to the extension arms 20, 22. In the optional embodiment of FIG. 3, the guidance and support is provided by guides 32 secured to the panel 28 upon which the extension arms 20, 22 may rest. The mount 26 further includes fasteners 34 to hold the mount 26 to the hanger 10. The fasteners 34 could take many optional forms. For example, the fasteners 34 may be as simple as curved hooks that rest over the shoulders 12, 14 or may further include a flap that folds over the shoulders 12, 14 and is secured by means such as a snap 36, rivet, clip, clasp, or the like.

Referring generally to FIGS. 1–3, the extension arms 20, 22 further include locks to secure the extension arms 20, 22 in a desired position. As shown in FIGS. 1 and 2, the locks may be one or more notches 40 in an adjuster strip 42 connected to each extension arm 20, 22. In an optional embodiment, the adjuster strip 42 is integral with the extension arm 20, 22. According to the present invention, the notches 40 may engage the hook 16, as shown, or may engage a protuberance or projection (not shown) on the hanger 10. In the embodiment of FIG. 3, the extension arms 20, 22 are adjusted by disengaging the notch 40 from the hook 16, protuberance, or projection and slidably adjusting the extension arm 20, 22 to the desired position. The extension arm 20, 22 is then secured by engaging a notch 40 on the adjuster strip 42 to the hook 16, protuberance, or projection.

An alternate optional embodiment is illustrated in FIG. 3. In the embodiment of FIG. 3, the lock takes the form of a series of ridges 44 that engage a detent 46. Optionally, the ridges 44 are of a barbed or sawtooth pattern known in the art. While the ridges 44 shown in FIG. 3 are on the extension arm 20, 22 and the detent 46 is secured to the mount 26, the present invention contemplates that the arrangement could be reversed with the ridges 44 on the mount 26 on the shoulders 12, 14 and the detent 46 on the extension arms 20, 22. To position the extension arms 20, 22 in such an embodiment, the ridges 44 are first disengaged from the detent 46. Optionally a release (not shown) may be provided to aid in the disengagement. The extension arms 20, 22 are slidably adjusted to the desired positions and the detent 46 engages the ridges 44 to hold the extension arms 20, 22 in place.

Similarly, in the embodiment of FIG. 4, the lock takes the form of one or more studs 48 on the extension arms 20, 22 that mate with a series of openings 50 in the upper margin of the mount 26. As the studs 48 on the extension arms 20, 22 are relocated to different openings 50, the extension arms 20, 22 move along the shoulders 12, 14 of the hanger 10.

In use, the present device could be mounted to a clothing hanger 10 of new construction or retrofitted onto an existing clothing hanger 10. In the embodiment of FIGS. 1 and 2, the extension arms 20, 22 are fixed to a clothing hanger 10 by merely placing the receiver 24 over the end of the shoulders 12, 14 of the hanger 10 and securing the notch 40 on the adjuster strip 42 to the hook 16, protuberance, or projection. In the embodiment of FIG. 3, the extension arms 20, 22 are fixed to a clothing hanger 10 by fastening the mount 26 to the clothing hanger 10 using fasteners 34. That is, in FIG. 3, the mount 26 is fixed to a clothing hanger 10 by securing the fasteners 34 to the shoulders 12, 14 of the clothing hanger 10. The extensions arms 20, 22 are then adjusted to the desired width. Similarly, in the embodiment of FIG. 4, the mount 26 is fixed to the clothing hanger 10 by securing fasteners 34 to the edge of the clothing hanger 10. The extension arms 20, 22 may then be adjusted as desired.

Figure 5:
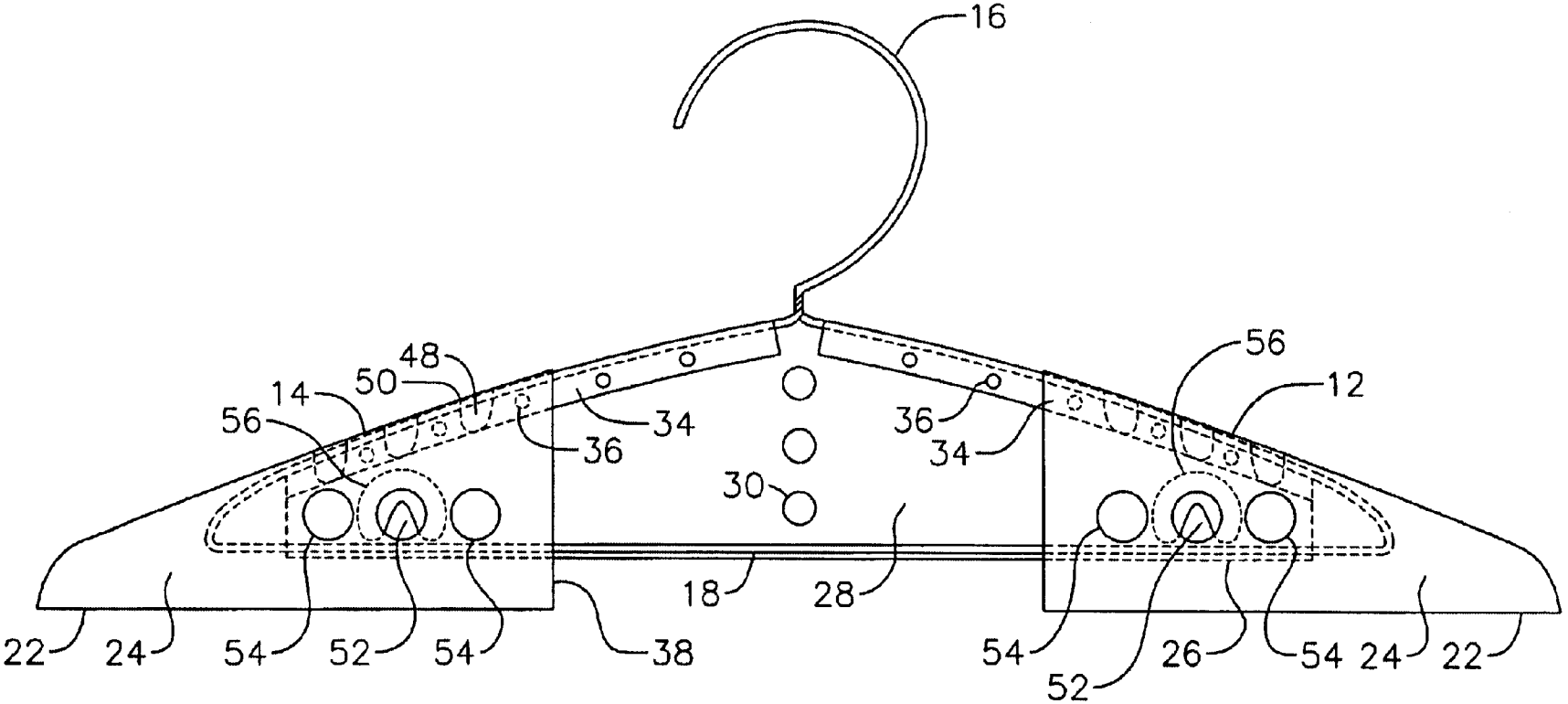
FIG. 5 is a front view of a clothing hanger according to an alternate embodiment of the present invention.

Referring to FIG. 5, an alternate embodiment is contemplated in which clothing hooks 52 are provided on the hanger 10 to receive clothing that may is more appropriately hanged from clothing hooks 52 rather than the shoulders 12, 14 and extension arms 20, 22. For example, straps from dresses or the like could be hanged from the clothing hooks 52. As can be appreciated, the clothing hooks 52 could extend from the extension arms 20, 22 or the mount 26, however, in the embodiment of FIG. 5, the clothing hooks 52 are disposed on the mount 26 inside holes 56 that align with holes 54 on the extension arms 20, 22. In an alternate embodiment, it is contemplated that the clothing hooks 52 may be disposed on the extension arms 20, 22 such that the distance between the clothing hooks 52 is adjustable.

While certain embodiments of the present invention have been shown and described it is to be understood that the present invention is subject to many modifications and changes without departing from the spirit and scope of the claims presented herein.

I claim:

1. A clothing hanger of adjustable size, comprising:

right and left shoulders;

a hook disposed between said shoulders;

right and left extension arms slidably movable with respect to the hanger in alignment with said right and left shoulders, respectively;

guides engaging said right and left extension arms to guide the sliding of said right and left extension arms parallel to said right and left shoulders, respectively;

locks mating with said right and left extension arms having disengaged and engaged positions, said locks permitting said right and left extension arms to slide parallel to said right and left shoulders to a desired length when disengaged and securing said right and left extension arms from sliding from a desired length when engaged; and a mount secured over the right and left shoulders of said hanger with at least one panel substantially parallel to the plane formed by the right and left hanger shoulders, said panel supporting the right and left extension arms, guides, and locks.

2. The device of claim 1 wherein said locks comprise a releasable detent on said mount engaged to ridges along said right and left extension arms.

3. The device of claim 1 wherein said mount further comprises a retainer on said panel for holding articles of clothing.

4. A clothing hanger of adjustable size, comprising:

right and left shoulders;

a hook disposed between said shoulders;

right and left extension arms slidably mounted to the hanger in alignment with said right and left shoulders, respectively;

guides disposed on said right and left shoulders to guide the sliding of said right and left extension arms parallel to said right and left shoulders, respectively, said guides comprising receivers on said right and left extension arms receiving the ends of said right and left shoulders, respectively, said receivers sized and shaped for sliding engagement along said right and left shoulders;

locks on said right and left extension arms having disengaged and engaged positions, said locks permitting said right and left extension arms to slide parallel to said right and left shoulders to a desired length when disengaged and securing said right and left extension arms from sliding from a desired length when engaged; and an adjuster strip extending from said right and left extension arms to said hook, such that said locks comprise notches along said adjuster strip that are selectively engaged to said hook to secure said right and left extension arms from sliding along said right and left shoulders.

* * * * *